US006070961A

United States Patent [19]

Premnath et al.

[11] Patent Number: 6,070,961

[45] **Date of Patent: *Jun. 6, 2000**

[54] PRIMING STATION FOR AN INK JET PRINTER

[75] Inventors: Karai P. Premnath, Rochester; Kenneth W. Altfather, Fairport, both of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/933,813

[22] Filed: Sep. 19, 1997

[51] Int. Cl.[7] ..... B41J 2/165

[52] U.S. Cl. ..... 347/30

[58] Field of Search ..... 347/30, 85, 29, 347/89

[56] References Cited

U.S. PATENT DOCUMENTS

| | | | |
|---|---|---|---|
| 4,638,337 | 1/1987 | Torpey et al. | 347/65 |
| 4,849,774 | 7/1989 | Endo et al. | 347/37 |
| 5,341,162 | 8/1994 | Hermanson et al. | 347/92 |
| 5,432,538 | 7/1995 | Carlotta | 347/30 |
| 5,555,461 | 9/1996 | Ackerman | 347/33 |

*Primary Examiner*—N. Le
*Assistant Examiner*—Michael Nghiem

[57] ABSTRACT

A priming station for an ink jet printer includes an ink accumulator tank which has an enhanced moisture vapor transfer rate based on a choice of materials and tank design. In a preferred embodiment, the ink accumulator tank is connected between a printhead nozzle face capping member and a vacuum pump. The tank comprises a tub bonded to a cover having holes formed therethrough. A thin, highly permeable film which provides a relatively high moisture vapor transfer rate is adhesively bonded to the cover overlying the holes. In a preferred embodiment, the film is a thin (0.635 to 0.78 mm thick) silicone or Mylar. This design reduces the accumulator tank replacement frequency by increasing the evaporation rate of the ink stored in the tank.

5 Claims, 3 Drawing Sheets

PRIMING STATION FOR AN INK JET PRINTER

BACKGROUND OF THE INVENTION AND MATERIAL DISCLOSURE STATEMENT

The present invention relates generally to ink jet printers and, more particularly, to a priming system for priming a printhead during periodic maintenance procedures.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then refilled by capilary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 5,555,461 and 5,432,538.

In one preferred priming method shown in FIG. 1, a vacuum is created by a diaphragm pump 2 connected to a cap 4 that is brought into sealing engagement with the nozzle face 6 of a printhead 10. An ink accumulator 8 is connected between the printhead and the pump by tubes 11,12 connected to ports 14 and 16, respectively. The accumulator must be formed of materials having characteristics such as sufficient strength to withstand the vacuum force applied by the pump, ease of manufacture, low cost and compatibility with the ink to be collected. One material that is preferred for an ink accumulator is polypropylene, an inexpensive engineering material that is amenable to ease of manufacture. A disadvantage of polypropylene is its very low moisture vapor transfer rate (MVTR). Since the capacity of accumulator 8 is finite, it imposes limitations on the maintenance system to handle waste ink deposited by the priming function. The most obvious limitation is the frequency with which the accumulator must be periodically replaced when filled. Another limitation is that the cap 4 can itself become filled with ink by vacuum pressure reduction or cessation resulting in degradation of quality of output prints formed by the printer.

SUMMARY OF THE INVENTION

It is, therefore, one object of the invention to improve the priming function by providing an ink accumulator which can provide more efficient storage of ink ejected from the printhead during a priming process. It is another object of the invention to enhance the life of the accumulator by reducing the frequency of ink disposal.

It is a further object of the invention to enhance the MVTR of the accumulator without sacrificing the desired characteristics of the material used for the accumulator.

These, and other objects, are realized by providing an accumulator tank with at least a portion of the wall surface of the tank formed by a thin permeable film having a high MVTR relative to the remaining walls. The permeable film increases evaporation of the stored ink and extends the time period for replacing of the ink accumulator.

In one embodiment, the accumulator comprises a polypropylene tank with relatively thick side walls, floor and top cover, but with the top cover having a number of holes formed therethrough. The holes are covered by a thin, high MVTR silicone film. The perforated surface retains the structural strength to withstand the vacuum pressure while increasing the evaporation of stored ink through the permeable film.

More particularly, the present invention is related to a priming station for an ink jet printer, the priming station comprising:

means for sealingly attached a cap member to the nozzle face of a printhead, a vacuum source, an ink accumulator tank connected between said cap member and said vacuum source and means for activating the vacuum source drawing ink from the printhead through the nozzle face and collecting ink in the accumulator tank, the accumulator tank characterized by having walls of different permeability.

DESCRIPTION OF THE INVENTION

Figure 1:
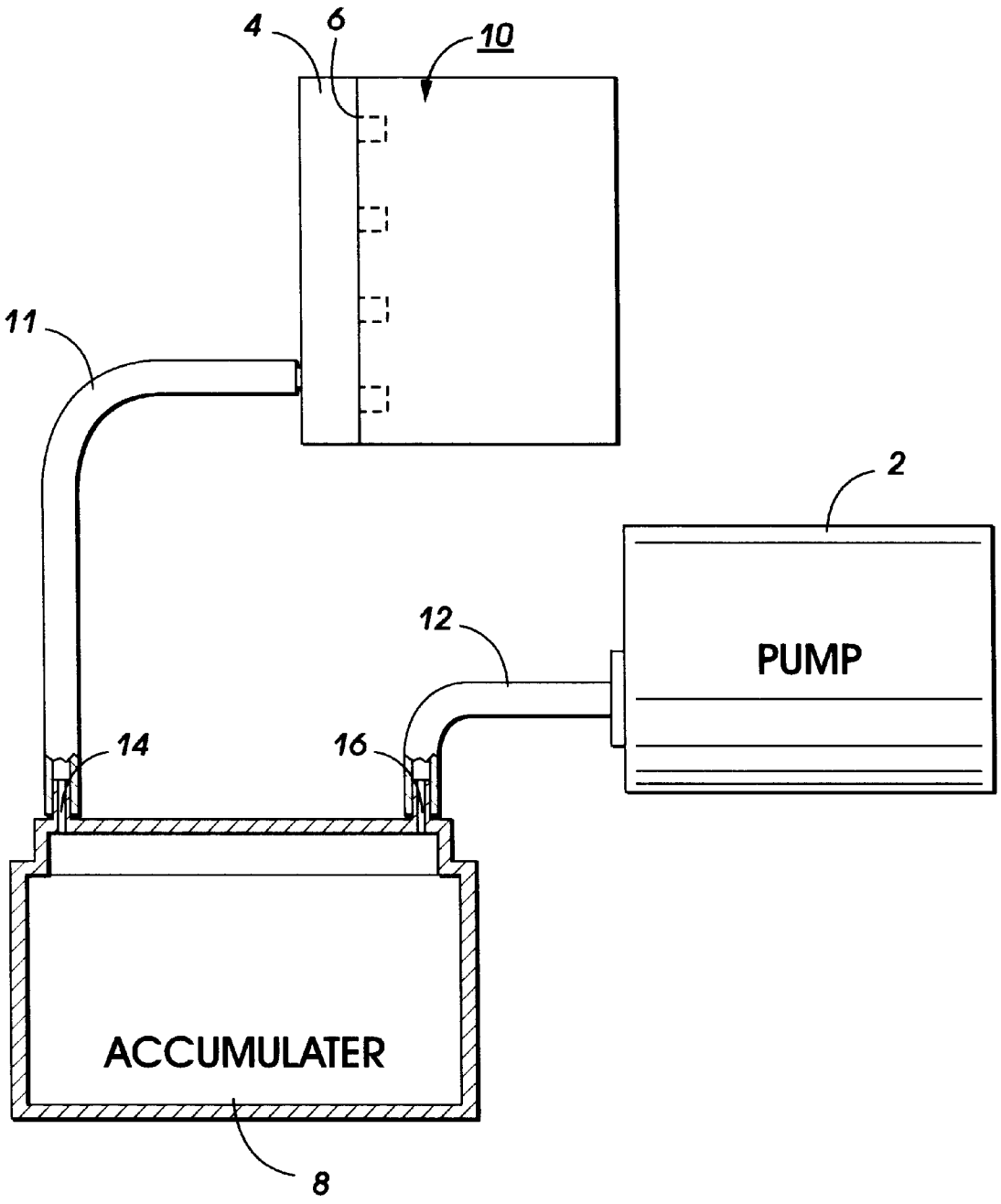
FIG. 1 PRIOR ART
FIG. 1 shows a prior art ink jet printer priming station.
Figure 2:
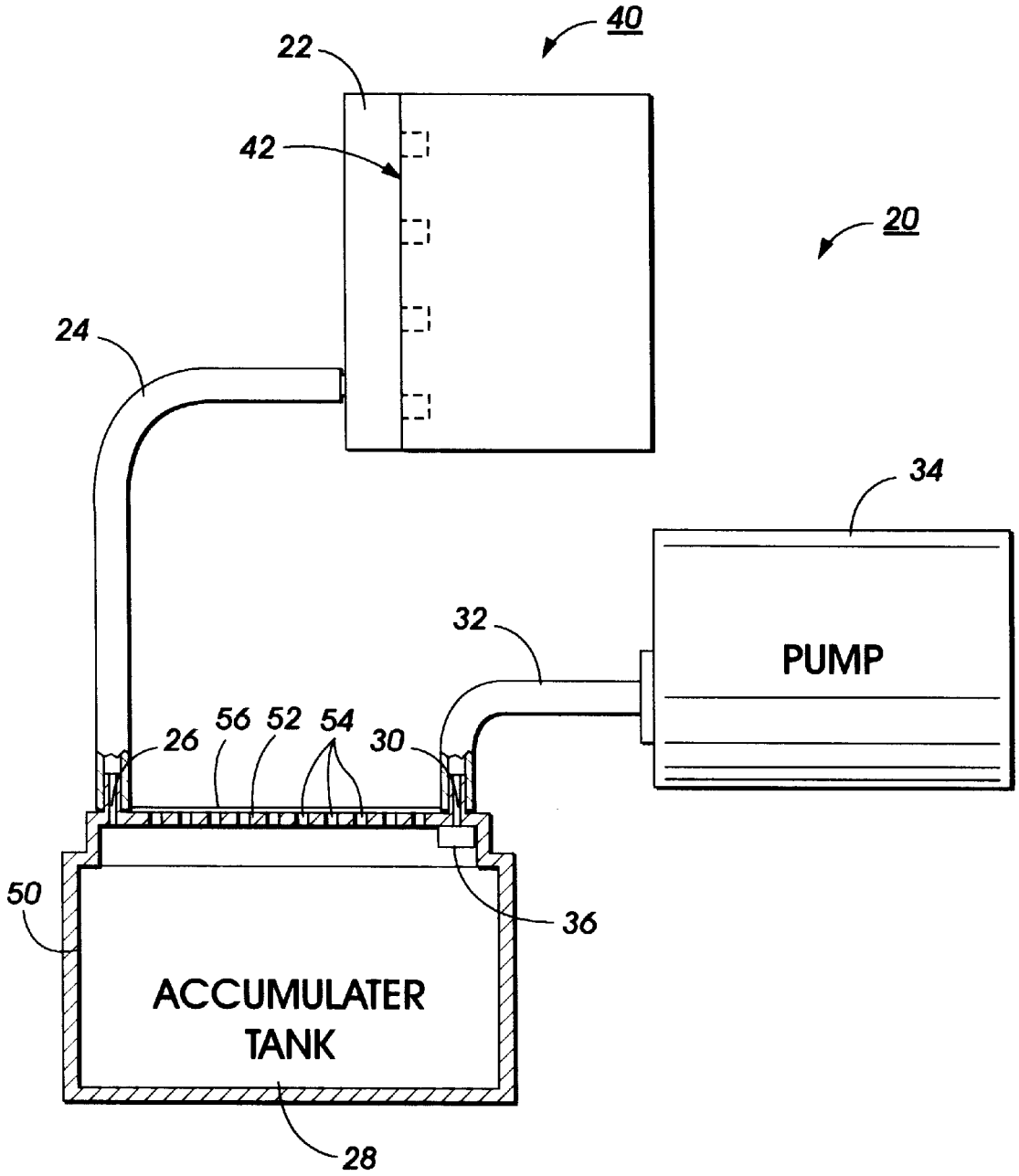
FIG. 2 shows an ink jet printer priming station with an ink accumulator tank formed according to the invention.
Figure 3:
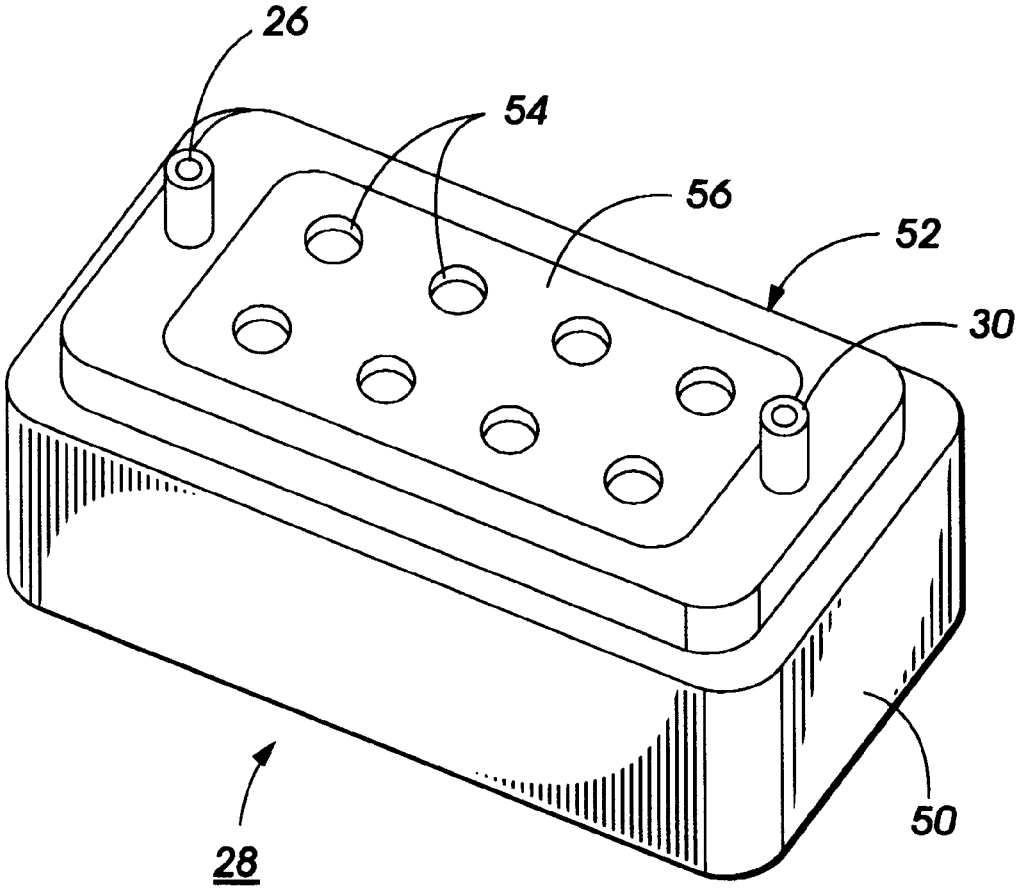
FIG. 3 shows an enlarged perspective view of the accumulator tank of FIG. 2.

FIG. 2 shows a side view of an ink jet printer priming station 20 which comprises a capping member 22 connected by tube 24 to inlet port 26 of ink accumulator tank 28. Outlet port 30 of tank 28 is connected by tube 32 to vacuum pump 34. Port 30 includes a one-way seal 36 to prevent ink from passing from a full tank into tube 32 and ink pump 34.

The priming station is part of a printer which includes a printhead 40 having a nozzle face 42. The printhead is fixed to an ink supply cartridge which is removably mounted on a carriage which is carried from a print zone into the priming station. Details of a printer which describes the carriage motion and printhead engagement with capping member 22 is disclosed in U.S. Pat. No. 5,555,461, whose contents are hereby incorporated by reference.

Continuing with a description of FIG. 2, tank 28 consists of two parts, a tub section 50 and a cover 52 having a plurality of holes 54 formed therethrough. A thin permeable film 56 is adhesively bonded to the surface of cover 52. Tub section 50 and cover 52 are 1.5 mm thick polypropylene ultrasonically bonded together to provide a leak-free seal. In a preferred embodiment, film 56 is a 0.78 mm thick silicone film that is etched on one side so as to adhesively bond to cover 52. The MVTR of film 56 was measured to be 0.6 gms/24 hrs/100 $in^2$ @ 38° C.-80% RH. The MVTR, for example, of the 1.5 mm polypropylene tub section and cover is 0.002 gms/24 hrs/100 $in^2$ @ 38° C.-80% RH, a much lower value providing far less permeability. The advantage of this preferred embodiment is to enhance the water vapor loss of the accumulator while at the same time preserving the structural integrity of the accumulator. Further, silicone, like polypropylene, is fully compatible with most ink sets.

In operation, printhead nozzle face 42 is brought into ink sealing contact with capping member 22 as described in the '461 patent. Pump 34 is activated to create a vacuum pressure of 8–10 psi and initiates a priming operation whereby ink is withdrawn from the printhead nozzles. The ink travels along tube 24 to collect in tub 50. The polypropylene is inert to the ink, and the ink begins to fill the tub 50. Because of increased evaporation of the collected ink through the film covered holes 54 (as opposed to the evaporation rate without the film), a longer time period will elapse before the ink reaches the level requiring the replacement of the tank.

While the embodiment of FIG. 2 shows holes 54 in the top cover, it is understood the holes could be formed in other surfaces of tub 50 (e.g. side walls, floor). The number of holes is determined by the rigidity requirements and the MVTR that is desired. The essential requirement is that at least some surface of the tub be more permeable than other surfaces. Also, while the film 56, in a preferred embodiment, is 0.78 mm thick, a range of 0.635 to 0.78 mm has been found satisfactory for most applications.

While a preferred embodiment of the accumulator was disclosed above, it is understood that other embodiments are contemplated consistent with the principles of the invention. As one example, the accumulator could be formed of a single molded part with at least one surface being more permeable than the other surfaces.

Another material suitable for film 56 is Mylar.

While the embodiment disclosed herein is preferred, it will be appreciated from this teaching that various alternative, modifications, variations or improvements therein may be made by those skilled in the art, which are intended to be encompassed by the following claims:

We claim:

1. In an improved priming station for use in an ink jet printer which uses a water-based ink, the priming station having a cap member for sealingly capping a printhead nozzle face, ink accumulator for receiving ink from said cap member and having an inlet port and outlet port, a vacuum pump, means to connect the cap member to the inlet port of the accumulator, and means to connect the vacuum pump to the outlet port of the accumulator, wherein the improvement comprises:

said ink accumulator comprising a tub section for the collection of ink therein, a cover having an outer surface and being sealingly attached to the tub section, a permeable film having a predetermined MVTR and being bonded to the outer surface of the cover, and a one-way seal for the outlet port to prevent ink accumulated in the ink accumulator from passing through the outlet port and entering into the vacuum pump, said cover having a plurality of holes therethrough and said film sealingly covering the plurality of holes, whereby the cover provides structural integrity to the ink accumulator while the holes therein enable water vapor loss from the ink through the film covering the holes at a sufficient rate to increase the time periods for replacement of the ink accumulator.

2. The station of claim 1, wherein the tub section and cover are polypropylene and the film is silicone having a thickness of 0.635 mm to 0.78 mm.

3. The station of claim 1, wherein the tub section and cover are polypropylene and the film is Mylar having a thickness of 0.635 mm to 0.78 mm.

4. The station of claim 1, wherein the film is etched on one side so as to adhesively bond to the outer surface of said cover.

5. The station of claim 1, wherein the MVTR of the film is 0.6 gms/24 hrs/100 sq in @ 38° C.-80% RH.

* * * * *